United States Patent [19]

Urban

[11] 4,401,549

[45] Aug. 30, 1983

[54] LIQUEFACTION OF CALCIUM-CONTAINING COALS

[75] Inventor: Peter Urban, Northbrook, Ill.

[73] Assignee: UOP Inc., Des Plaines, Ill.

[21] Appl. No.: 322,335

[22] Filed: Nov. 17, 1981

[51] Int. Cl.[3] ..... C10G 1/00; C10L 1/04

[52] U.S. Cl. ..... 208/8 LE; 44/1 SR

[58] Field of Search ..... 208/8 LE; 44/1 SR

[56] References Cited

U.S. PATENT DOCUMENTS

| | | | |
|---|---|---|---|
| T700485 | 1/1968 | Hemminger | 208/8 LE |
| 1,436,289 | 11/1922 | Plauson | 208/8 LE |
| 4,161,440 | 7/1979 | Brunson | 208/8 R |
| 4,206,033 | 6/1980 | Neavel et al. | 208/8 LE |
| 4,304,655 | 12/1981 | Poddar | 208/8 LE |
| 4,322,283 | 3/1982 | Maa et al. | 208/8 LE X |
| 4,332,666 | 6/1982 | Bauman et al. | 208/8 LE |

*Primary Examiner*—Delbert E. Gantz
*Assistant Examiner*—William G. Wright
*Attorney, Agent, or Firm*—James R. Hoatson, Jr.; John G. Cutts, Jr.; William H. Page, II

[57] ABSTRACT

An improved process for the treatment and liquefaction of calcium-containing subbituminous coal and coals of lower rank to form water soluble compounds of calcium, thereby suppressing the formation of scale, made up largely of calcium carbonate which normally forms within the coal liquefaction zone, e.g. on reactor surfaces, lines, auxiliary equipment and the like. An oxide of sulfur is contacted with a coal feed sufficient to impregnate the pores of the coal. The impregnated coal is then contacted with hydrogen sulfide to produce water soluble thiosulfate. After the treated coal is liquefied in a coal liquefaction zone, the effluent is water washed to remove the water soluble thiosulfate.

9 Claims, No Drawings

LIQUEFACTION OF CALCIUM-CONTAINING COALS

BACKGROUND OF THE INVENTION

The present invention relates to the liquefaction of coal. During the conversion or liquefaction of coal which contains calcium, calcium carbonate scale normally forms on the surfaces of the coal liquefaction reactor, lines, auxiliary equipment and the like. The scale is extremely troublesome while attempting to obtain long continuous runs of the liquefaction process because eventually the flow through the narrowest sections of the plant is drastically impeded or closed. Therefore, it is essential that calcium and the like foulants be rendered innocuous if a successful coal conversion process is desired. The present invention proposes to solve the carbonate scale deposition problem by contacting coal with a sulfur oxide to form calcium sulfite, contacting the treated coal and resulting calcium sulfite with hydrogen sulfide to produce water soluble thiosulfate, liquefying the treated coal in a coal conversion zone and then contacting the effluent from the coal conversion zone with water to remove the water soluble thiosulfate.

U.S. Pat. No. 4,161,440 (Brunson), teaches a method to minimize the formation of scale during coal liquefaction by adding sulfur oxide with the coal prior to liquefaction to form a molecular species which deposits within the pores of the coal. This resulting molecular species is thermally stable and does not decompose at liquefaction conditions, and during liquefaction remains as particulate solids and thereby does not form or at least suppresses the formation of scale, or calcium carbonate deposits. The insoluble form of calcium remains within the liquefaction bottoms, or ash, and is conveniently disposed of, after liquefaction, with the liquefaction bottoms.

Although the process of U.S. Pat. No. 4,161,440 (Brunson) reduces the formation of scale in the coal liquefaction zone, the quantity of ash which must be ultimately separated from the desirable products of the liquefaction is increased. Separation of ash is a large and difficult task associated with the liquefaction of coal and any effort to minimize the quantity of ash to be separated is advantageous. My invention converts ash precursors in contradistinction to U.S. Pat. No. 4,161,440 (Brunson) to water soluble compounds which may easily be separated from the liquefaction zone effluent.

BRIEF SUMMARY OF THE INVENTION

It is a broad objective of my process to make available an improved method for the liquefaction of calcium-containing coal.

In brief summary, a preferred embodiment of my invention is a process for liquefying a calcium-containing coal and which process comprises: contacting the coal with a sulfur oxide to form calcium sulfite; contacting the treated coal from the previous step and resulting calcium sulfite with hydrogen sulfide to produce water soluble thiosulfate; liquefying the treated coal from the previous step in a coal liquefaction zone; and contacting the effluent from the coal conversion zone with water to remove said water soluble thiosulfate.

Other objectives and embodiments of my invention encompass details about coal types, reagents and reaction condition, all of which are hereinafter disclosed in the following discussion of each of the facets of the invention.

DESCRIPTION OF THE INVENTION

The present invention contemplates utilizing a subbituminous or lower rank undried, or raw coal which is crushed, ground or reduced in size by conventional means to particulate solids, preferably of particle size ranging from about 20 to 8 mesh or smaller. The process of the present invention is preferably employed when processing calcium-containing coal. The finely divided coal is contacted with a sulfur oxide to form calcium sulfite. The sulfur oxide may be selected from sulfur dioxide, sulfur trioxide or mixtures thereof. The contacting of the finely divided coal with the sulfur oxide is performed in any suitable and convenient method and is preferably conducted at a pressure ranging from about 0 to about 3000 psig for a period of at least about 0.01 to about 24 hours. The period of contact is conducted at a temperature ranging from about 32° F. to about 200° F. The quantity of sulfur oxide supplied must be sufficient to effectively convert essentially all of the calcium and any other potential scale precursors to the corresponding sulfite. It is contemplated that the sulfur oxides may be present in the gas phase, liquid phase or combination thereof. The treated coal and resulting calcium sulfite is then contacted with hydrogen sulfide to produce water soluble thiosulfate. This contacting step may also be performed in any suitable and convenient method and is preferably conducted at a pressure ranging from about 0 to about 3000 psig for a period of at least about 0.01 to about 24 hours. The period of contact is preferably conducted at a temperature ranging from about 32° F. to about 200° F. At least stoichiometric quantities of hydrogen sulfide are preferred.

The step-wise contacting of the coal with sulfur oxide and subsequently with hydrogen sulfide may be performed with the raw coal or may be performed with a coal slurry. A coal slurry may be prepared by contacting the coal with a liquid hydrocarbon solvent in a solvent-to-coal ratio ranging from about 0.8:1 to about 6:1, preferably about 1.1:1 to about 1.8:1, based on weight. The hydrocarbon solvent is suitably one which boils within the range of about 250° F. to about 1000° F., preferably from about 290° F. to about 900° F.

After the coal or coal slurry is sequentially contacted with the sulfur oxide and the hydrogen sulfide, the coal stream may optionally be separated from any unreacted sulfur oxide and hydrogen sulfide. The particulate coal or coal slurry is then introduced to a liquefaction zone.

Within the coal liquefaction zone, liquefaction conditions include a temperature ranging from about 500° F., preferably from about 700° F. to about 850° F., with pressures ranging from about 100 psig to about 3500 psig, preferably from about 800 psig to about 3000 psig. Preferably, molecular hydrogen is also added to the liquefaction zone at a rate from about 1 to about 10 weight percent on a moisture and ash-free coal basis. Liquid residence times ranging from about 5 to about 200 minutes, and preferably from about 10 to about 150 minutes may be employed. Additionally, the liquefaction zone may receive a recycle stream comprising hydrocarbon solvent, unreacted coal, ash or mixtures thereof which stream is derived from the liquefaction zone effluent.

The effluent from the liquefaction zone consists of gases and liquids, the liquids comprising a mixture of hydrocarbon solvent, dissolved coal, undissolved coal and mineral matter or ash. The product thus includes petroleum-like liquids boiling below about 1000° F. and heavier products. The heavy products, or "liquefaction bottoms" consist of organic hydrocarbons boiling at greater than 1000° F., inorganic, carbon residue and water soluble thiosulfate. This bottoms material, exclusive of the thiosulfate, contains about 60–70 weight percent carbon, and about 20 weight percent ash and is less useful than the 1000° F.-minus hydrocarbon liquid and generally contains 40–50 weight percent of the original feed coal to the process.

The effluent stream from the liquefaction zone is contacted with water to dissolve and remove the water soluble thiosulfate and this contacting step may be performed in any suitable and convenient manner. The temperature and pressure are preferably selected to maintain the water in liquid phase in order that the thiosulfate is dissolved. Generally, ample water is supplied to the washing step to ensure the complete removal and dissolution of the water soluble thiosulfate. An approximate estimate of the amount of water required is determined from the quantity of thiosulfate expected based on the chemical analysis of the particular coal which is being processed. The resulting aqueous solution of thiosulfate is then separated from the remaining liquefaction zone effluent which effluent may then be separated into valuable hydrocarbons, a liquefaction zone recycle stream and a drag stream.

The present invention may employ a hydrogenation catalyst in the liquefaction zone which catalyst may be supported or unsupported. Suitable hydrogenation catalysts are known in the art and are conventional for coal liquefaction. Typically, supported catalysts comprise an alumina or silica-alumina support carrying one or more Group VIII non-noble or iron group metals and one or more Group VI-B metals of the Periodic Table. In particular, combinations of one or more Group VI-B metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. Methods for the preparation of these catalyst are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite, and montmorillonite, can also be employed. The hereinabove mentioned metals and their oxides or sulfides may be employed as unsupported catalysts and are generally finely divided and dispersed in the reactants. The catalyst concentration generally ranges from about 0.01 to 10 weight percent metal, preferably from about 0.1 to about 5 weight percent metal based on the weight of the coal.

The process of the present invention is further exemplified by the following illustrative embodiment. This illustration is not present to unduly limit the process of this invention, but to further demonstrate the hereinabove teachings.

ILLUSTRATIVE EMBODIMENT

A 100 gram portion of Wyodak coal (or Arkansas lignite) is pulverized to provide particles sufficiently small to pass through a 10 mesh Tyler screen. The resulting comminuted coal is contacted with 75 grams of liquid sulfur dioxide at a temperature of 80° F. and a pressure of 35 psig for approximately 20 minutes. This treated coal and resulting calcium sulfite then was contacted with a stoichiometric excess of hydrogen sulfide at a temperature of 80° F. and a pressure of 250 psig for approximately 10 minutes. After the hydrogen sulfide treatment, the resulting coal is slurried with 150 grams of previously extracted asphaltene-free hydrogenated coal oil solvent boiling in the range from about 300° F. to about 700° F. The slurried coal and 8 grams of hydrogen is charged to a liquefaction zone maintained at a pressure of 2500 psig, and a temperature of 785° F. for 90 minutes. The contents of the coal liquefaction zone are recovered and washed with 300 grams of water. After the wash water is separated from the liquefaction zone effluent, the wash water is found to contain essentially all of the calcium which was present in the coal feedstock.

The foregoing specification and illustrative embodiment clearly indicate the means by which the present invention is effected, and the benefits afforded through the utilization thereof.

I claim:

1. A process for liquefying a calcium-containing coal by converting said calcium to the harmless calcium thiosulfate form before liquefaction and removing said calcium thiosulfate from the liquefaction product effluent, which process comprises:

(a) contacting said calcium-containing coal with a sufficient amount of a sulfur oxide to convert substantially all of said calcium to calcium sulfite and to form an admixture comprising coal and calcium sulfite;

(b) contacting said coal, and calcium sulfite admixture with a sufficient quantity of hydrogen sulfide to convert said calcium sulfite to the corresponding calcium thiosulfate;

(c) liquefying at liquefication conditions said coal in a liquefaction zone to produce a liquefaction effluent stream comprising hydrocarbonaceous products and calcium thiosulfate without carbonate scale deposition problems; and (d) removing said calcium thiosulfate from said hydrocarbonaceous products by contacting said effluent with an aqueous stream to dissolve said calcium thiosulfate in said aqueous phase and physically separating said aqueous phase from said hydrocarbonaceous product stream.

2. The process of claim 1 wherein said sulfur oxide is sulfur dioxide.

3. The process of claim 1 wherein said sulfur oxide is sulfur trioxide.

4. The process of claim 1 wherein said sulfur oxide comprises an admixture of sulfur dioxide and sulfur trioxide.

5. The process of claim 1 wherein the contacting of the coal with the sulfur oxide is conducted at pressures ranging from about 0 to about 3000 psig and at temperatures ranging from about 32° F. to about 200° F.

6. The process of claim 1 wherein the contacting of the treated coal and resulting calcium sulfite with hydrogen sulfide is conducted at pressures ranging from about 0 to about 3000 psig.

7. The process of claim 1 wherein the contact between the coal and the sulfur oxide is maintained for a period of at least about 0.01 to about 24 hours.

8. The process of claim 1 wherein the contact between the treated coal and resulting calcium sulfite with hydrogen sulfide is maintained for a period of at least about 0.01 to about 24 hours.

9. The process of claim 1 wherein the coal conversion zone is maintained at conditions which include a pressure from about 100 to about 3000 psig, and a temperature from about 500° F. to about 850° F.

* * * * *